US007929724B2

(12) United States Patent
Funahashi

(10) Patent No.: US 7,929,724 B2
(45) Date of Patent: Apr. 19, 2011

(54) LOUDSPEAKER

(75) Inventor: Osamu Funahashi, Osaka (JP)

(73) Assignee: Panasonic Corporation, Osaka (JP)

( * ) Notice: Subject to any disclaimer, the term of this patent is extended or adjusted under 35 U.S.C. 154(b) by 382 days.

(21) Appl. No.: 11/575,267

(22) PCT Filed: Sep. 15, 2006

(86) PCT No.: PCT/JP2006/318399

§ 371 (c)(1),
(2), (4) Date: Mar. 14, 2007

(87) PCT Pub. No.: WO2007/034752

PCT Pub. Date: Mar. 29, 2007

(65) Prior Publication Data

US 2009/0060252 A1 Mar. 5, 2009

(30) Foreign Application Priority Data

Sep. 21, 2005 (JP) ..... 2005-273329

(51) Int. Cl.
*H04R 25/00* (2006.01)

(52) U.S. Cl. ..... 381/398; 381/403; 381/423

(58) Field of Classification Search ..... 381/398, 381/403, 404, 423, 432, 433; 181/171, 172, 181/173

See application file for complete search history.

(56) References Cited

U.S. PATENT DOCUMENTS

| | | | | |
|---|---|---|---|---|
| 5,847,333 | A * | 12/1998 | D'Hoogh | 181/171 |
| 6,031,925 | A * | 2/2000 | Shteyn | 381/401 |
| 2003/0079936 | A1 | 5/2003 | Kuze et al. | |
| 2003/0185415 | A1 * | 10/2003 | Funahashi et al. | 381/398 |
| 2003/0231784 | A1 | 12/2003 | Kuze et al. | |

FOREIGN PATENT DOCUMENTS

| | | |
|---|---|---|
| EP | 1 324 632 A1 | 7/2003 |
| GB | 1 260 124 A | 1/1972 |
| GB | 1 586 896 | 3/1981 |
| JP | 35-2305 | 2/1960 |
| JP | 45-033465 | 10/1970 |
| JP | 51-32097 | 9/1976 |
| JP | 53-046122 | 4/1978 |

(Continued)

OTHER PUBLICATIONS

Supplementary European Search Report for Application No. EP 06 79 8062 dated Mar. 25, 2008.

(Continued)

*Primary Examiner* — Huyen D Le
(74) *Attorney, Agent, or Firm* — RatnerPrestia

(57) ABSTRACT

A loudspeaker has a frame, a magnetic circuit, a voice coil body, a first edge, a diaphragm, a second edge, and a damper. The magnetic circuit is provided with a magnetic gap, and is supported by the frame. The voice coil body is disposed movably with respect to the magnetic gap. The outer peripheral end of the diaphragm is coupled to the frame via the first edge, and the inner peripheral end thereof is coupled to the voice coil body. The second edge is coupled to the frame at a position closer to the magnetic circuit than the first edge. The damper is disposed closer to the magnetic circuit than the diaphragm, the outer peripheral end thereof is coupled to the frame via the second edge, and the inner peripheral end thereof is coupled to the voice coil body.

8 Claims, 2 Drawing Sheets

FOREIGN PATENT DOCUMENTS

| | | | |
|---|---|---|---|
| JP | 03-109000 | A | 5/1991 |
| JP | 03-247099 | | 11/1991 |
| JP | 2004-007331 | | 1/2004 |
| JP | 2004-007332 | | 1/2004 |
| JP | 2005-273329 | | 7/2010 |
| KR | 10-0500804 | B1 | 7/2005 |
| WO | WO 02/102113 | A1 | 12/2002 |

OTHER PUBLICATIONS

Japanese Search Report for Application No. PCT/JP2006/318399 dated Dec. 12, 2006.

English translation of Form PCT/ISA/210, dated Oct. 31, 2008.

* cited by examiner

LOUDSPEAKER

TECHNICAL FIELD

The present invention relates to a structure for improving the driving efficiency of a loudspeaker of low acoustic strain.

BACKGROUND ART

FIG. 3 is a diagram showing a part of a cross section of a conventional loudspeaker. In this loudspeaker, voice coil body 22 movably disposed on magnetic circuit 21 is coupled to the inner peripheral end of diaphragm 23. The outer peripheral end of diaphragm 23 is coupled to frame 25 via edge 24. The back surface of diaphragm 23 is coupled to frame 25 via suspension holder 26 and edge 27. The projecting shapes of edges 24 and 27 are pointed to opposite directions, and hence the upside and downside of the amplitude of diaphragm 23 are vertically symmetric. Thus, the acoustic strain of the loudspeaker is reduced. Such a loudspeaker is disclosed in Japanese Patent Unexamined Publication No. 2004-7332, for example.

In such a loudspeaker structure, suspension holder 26 is formed of a rigid body with a rigidity equivalent to that of diaphragm 23. Therefore, the additional mass of diaphragm 23 is increased, and hence the driving load is increased on magnetic circuit 21. As a result, it is difficult to improve the driving efficiency of the loudspeaker.

SUMMARY OF THE INVENTION

The present invention can further improve the driving efficiency of a loudspeaker of low acoustic strain. The loudspeaker of the present invention has a frame, a magnetic circuit, a voice coil body, a first edge, a diaphragm, a second edge, and a damper. The magnetic circuit is provided with a magnetic gap, and is supported by the frame. The voice coil body is disposed movably with respect to the magnetic gap. The outer peripheral end of the diaphragm is coupled to the frame via the first edge, and the inner peripheral end thereof is coupled to the voice coil body. The second edge is coupled to the frame at a position closer to the magnetic circuit than the first edge. The damper is disposed closer to the magnetic circuit than the diaphragm, the outer peripheral end of the damper is coupled to the frame via the second edge, and the inner peripheral end thereof is coupled to the voice coil body. This structure can suppress the acoustic strain of the loudspeaker and improve the driving efficiency thereof.

DETAILED DESCRIPTION OF PREFERRED EMBODIMENT

Figure 1:
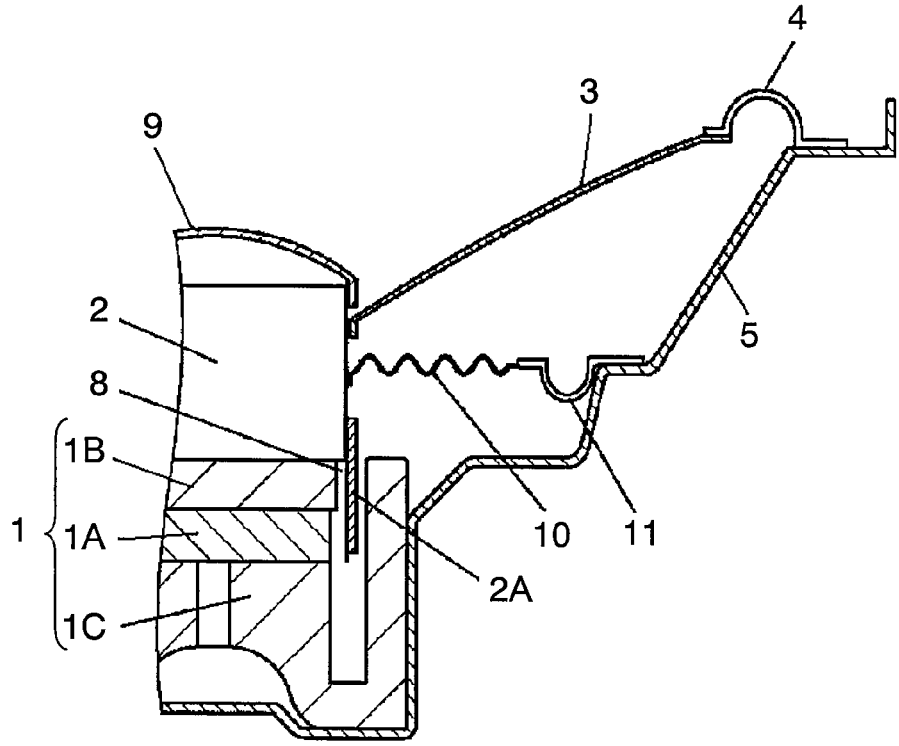
FIG. 1 is a diagram showing a part of a cross section of a loudspeaker in accordance with an exemplary embodiment of the present invention.

FIG. 1 is a diagram showing a part of a cross section of a loudspeaker in accordance with an exemplary embodiment of the present invention. Magnetic circuit 1 is disposed in the center of the bottom of bowl-like frame 5, namely it is supported by frame 5. Magnetic circuit 1 is formed by combining and sticking disk-like magnet 1A, disk-like plate 1B, and cylindrical yoke 1C having a closed-end. Magnetic gap 8 is formed between the inner peripheral side face of a side wall part of yoke 1C and the outer peripheral side face of plate 1B so as to open toward the upper face side of magnetic circuit 1. In other words, magnetic gap 8 opens toward diaphragm 3.

Voice coil body 2 is structured by winding a coil (not shown) on the outer periphery of cylindrical support body 2A. Voice coil body 2 is disposed vertically movably with respect to magnetic gap 8, and vibrates diaphragm 3 coupled to the outer periphery of the upper part of voice coil body 2. Dust cap 9 for dust-proofing is disposed at the upper end of voice coil body 2.

Diaphragm 3 is a part functioning as a sound source of a loudspeaker, and is mainly made of pulp and resin for establishing high rigidity and internal loss. The outer peripheral end of diaphragm 3 is coupled to the opening end of frame 5 via first edge (hereinafter referred to as "edge") 4 projecting upward. The inner peripheral end of diaphragm 3 is fixed to voice coil body 2. Edge 4 is made of urethane, foamed rubber, styrene butadiene rubber (SBR), or cloth in order to prevent a load from being applied to movement of diaphragm 3.

Damper 10 is disposed closer to magnetic circuit 1 than diaphragm 3. The inner peripheral end of damper 10 is coupled to voice coil body 2 at a position closer to magnetic circuit 1 than the position at which diaphragm 3 is fixed to voice coil body 2. The outer peripheral end of damper 10 is coupled to frame 5 via second edge (hereinafter referred to as "edge") 11 which is disposed separately from damper 10 and projects downward.

Damper 10 has a corrugated-sheet-shaped ring structure, and extends and contracts in response to movement of voice coil body 2. Similarly to edge 4, damper 10 is made of urethane, foamed rubber, SBR, or cloth in order to prevent a load from being applied to movement of diaphragm 3.

An operation of a loudspeaker having such a structure during driving is described hereinafter. When a voice signal is fed into the coil of voice coil body 2, the signal interacts with the magnetic field of magnetic gap 8 so that voice coil body 2 moves vertically. This movement vibrates diaphragm 3 to transmit sound from the loudspeaker. Especially, since edge 11 is disposed at the outer peripheral end of damper 10, the amplitude allowance of diaphragm 3 is increased, the acoustic strain of the loudspeaker is suppressed, and the driving efficiency of the loudspeaker is increased.

The inner and outer peripheral ends of damper 10 are connected to voice coil body 2 and edge 11, respectively. Damper 10 suppresses lateral vibration caused when voice coil body 2 moves. Damper 10 is structured in a corrugated sheet shape and has elasticity so as to easily follow the movement of voice coil body 2. When the amplitude value of voice coil body 2 is small, damper 10 having the corrugated sheet shape hardly applies a large load to the movement of voice coil body 2. While, when the amplitude value is large, damper 10 applies a large load.

In the loudspeaker of the present embodiment, the outer periphery of damper 10 is coupled to frame 5 via edge 11. Thanks to this structure, the movable width of voice coil body 2 increases, stress is added to edge 11 when damper 10 becomes a movable load, and edge 11 elastically deforms in response to this stress. Therefore, even when the vibration amplitude value of voice coil body 2 is large, the vibration amplitude of diaphragm 3 does not decrease, and the reduction in driving efficiency is suppressed. In addition, the projecting directions of edge 11 and edge 4 are opposite to each other. Thus, when edge 11 begins deforming, the load applied to the upward vibration of diaphragm 3 is not significantly different from the load applied to the downward vibration. Thus, increase in vibration load is suppressed by coupling damper 10 to frame 5 via edge 11. Since edge 4 and edge 11 project to the opposite directions on both sides of the boundary between them, the upward and downward vibration loads hardly differ from each other. These effects decrease the acoustic strain of the loudspeaker of the present embodiment.

In such a structure where damper 10 is coupled to frame 5 via edge 11, corrugated-sheet-shaped damper 10 can secure the linearity of the vibration amplitude until the movable width of voice coil body 2 is increased to some extent. When the movable width of voice coil body 2 becomes a predetermined value or more and it is difficult to secure the amplitude linearity, the elasticity of edge 11 compensates the amplitude linearity. Therefore, the elasticity of edge 11 is preferably set larger than that of damper 10, namely edge 11 is preferably harder than damper 10.

Preferably, damper 10 and edge 11 have different elasticity, and are set so as to independently work in response to the movable width of voice coil body 2. For that purpose, the elasticity of a portion between damper 10 and edge 11, specifically the elasticity of the coupling region between damper 10 and edge 11, is preferably set larger than those of both damper 10 and edge 11. Namely, the region is preferably harder than both damper 10 and edge 11. This setting of the elasticity of each component can secure the independence of damper 10 from edge 11.

For setting the elasticity of the coupling region between damper 10 and edge 11 to be larger than the elasticity of damper 10 and elasticity of edge 11, for example, the following method is used:

employing a hard adhesive such as an acrylic adhesive in order to stick edge 11 to damper 10;

integrating edge 11 and damper 10 by insert molding and increasing the thickness of the part; or sticking a reinforcing material on the coupling region.

For securing the linearity of the vibration amplitude of diaphragm 3 as a sound producing region of the loudspeaker, it is preferable not only to optimize the above-mentioned composite body of damper 10 and edge 11 but also to define the relation between the composite body of damper 10 and edge 11 and edge 4 disposed on diaphragm 3. In this relation, it is important how freely diaphragm 3 as a substantial sound source of the loudspeaker can vibrate vertically and uniformly. For making maximum use of the linearity of diaphragm 3 in consideration of this point, it is preferable to set the elasticity of the composite body of damper 10 and edge 11 substantially equivalent to that of edge 4. Accordingly, edge 11 is preferably set to be smaller than edge 4 as shown in FIG. 1.

In other words, damper 10 has a corrugated structure and a small elasticity (damper 10 is soft). Therefore, by making edge 11 to be smaller than edge 4, the elasticity of edge 11 is made increased (edge 11 is hardened). The elasticity of the composite body of damper 10 and edge 11 is thus set to be substantially equivalent to that of edge 4.

When voice coil body 2 as a driving point is disposed between edges 4 and 11 forming fulcrums and the interval between edges 4 and 11 is increased, lateral vibration of voice coil body 2 and diaphragm 3 is suppressed, and the acoustic strain is thus reduced. For securing the interval between edges 4 and 11, edge 4 is preferably projected on the side opposite to damper 10, and edge 11 is preferably projected on the side opposite to diaphragm 3.

Figure 2:
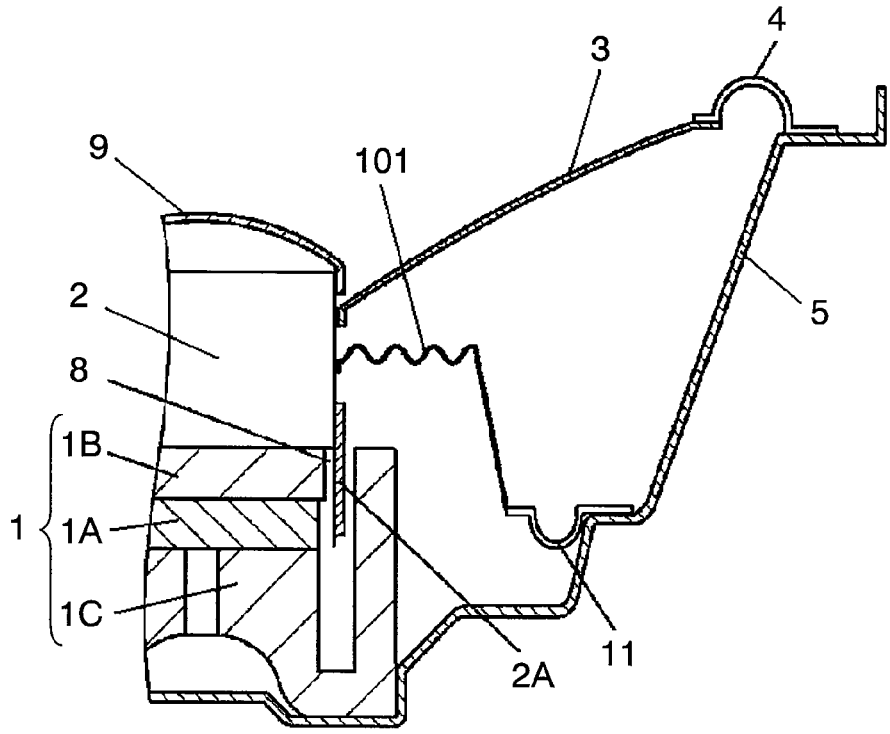
FIG. 2 is a diagram showing a part of a cross section of another loudspeaker in accordance with the exemplary embodiment of the present invention.
Figure 3:
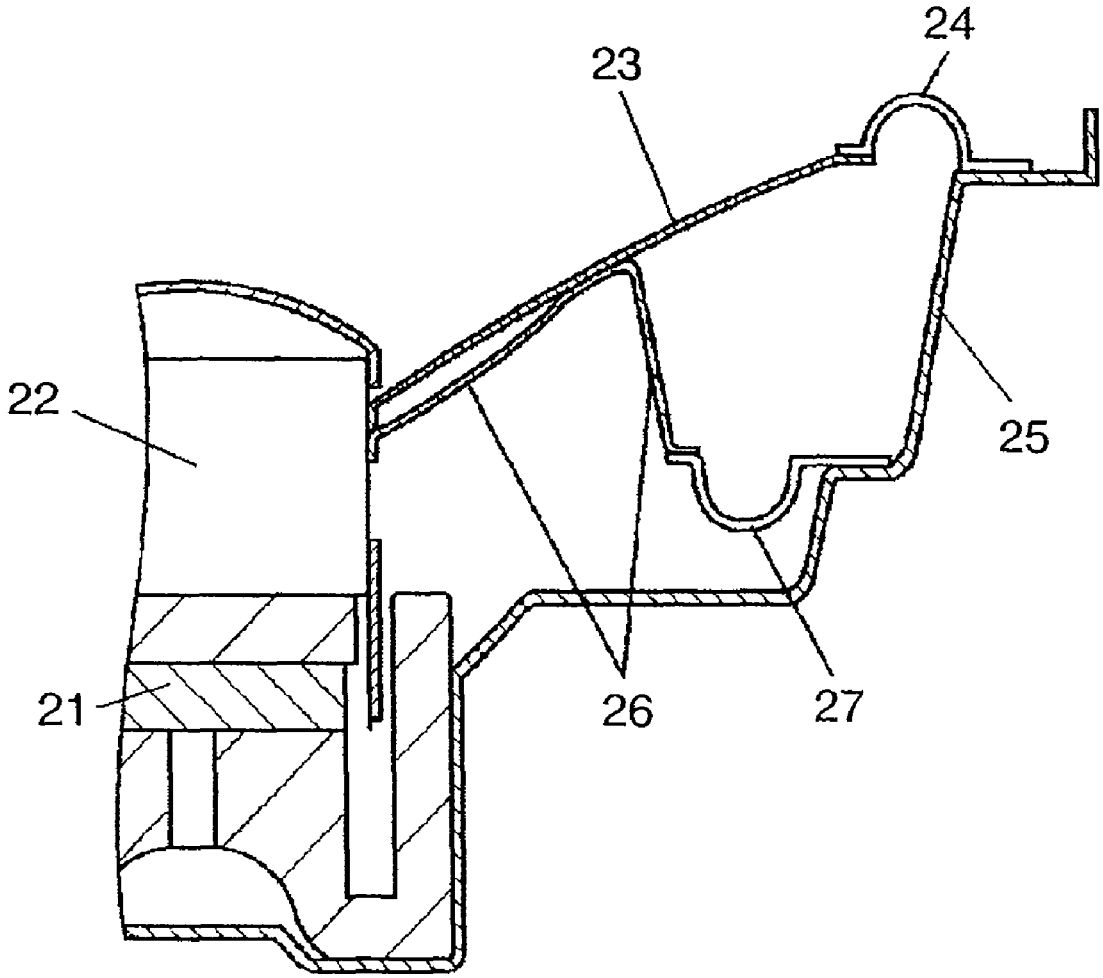
FIG. 3 PRIOR ART
FIG. 3 is a diagram showing a part of a cross section of a conventional loudspeaker.

Further, as shown in FIG. 2, damper 101 may be used, and the coupling position between edge 11 and frame 5 may be set to be lower than plate 1B positioned at the upper end of magnetic circuit 1. The outer peripheral end of damper 101 is bent in a direction getting away from diaphragm 3. In other words, the coupling position between edge 11 and frame 5 is farther from diaphragm 3 than the end of magnetic circuit 1 on the diaphragm 3 side.

In this structure, voice coil body 2 as a driving point between edges 4 and 11 forming fulcrums is disposed near the center between the fulcrums, the lateral vibration of diaphragm 3 is further suppressed, and the acoustic strain is significantly reduced.

INDUSTRIAL APPLICABILITY

The present invention can reduce the acoustic strain of a loudspeaker, can improve the driving efficiency thereof, and is useful especially for a small loudspeaker.

The invention claimed is:

1. A loudspeaker comprising:

a frame;

a magnetic circuit supported by the frame and provided with a magnetic gap;

a voice coil body disposed movably with respect to the magnetic gap;

a first edge having a first end and a second end, the second end connected to the frame;

a diaphragm, an outer peripheral end of the diaphragm connected to the first end of the first edge such that the diaphragm is coupled to the frame via the first edge, an inner peripheral end thereof being coupled to the voice coil body;

a second edge coupled to the frame at a position closer to the magnetic circuit than the first edge; and a damper disposed closer to the magnetic circuit than the diaphragm, an outer peripheral end of the damper being connected to only the second edge such that the damper is coupled to the frame via the second edge, an inner peripheral end of the damper being coupled to the voice coil body, the damper being less rigid than the diaphragm.

2. The loudspeaker according to claim 1, wherein the first edge projects on a side opposite to a side where the damper is disposed, and the second edge projects on a side opposite to a side where the diaphragm is disposed.

3. The loudspeaker according to claim 1, wherein an elasticity of a composite body formed of the damper and the second edge is substantially equivalent to an elasticity of the first edge.

4. The loudspeaker according to claim 3, wherein the second edge is smaller than the first edge.

5. The loudspeaker according to claim 1, wherein an elasticity of the second edge is larger than an elasticity of the damper.

6. The loudspeaker according to claim 1, wherein an elasticity of a coupling portion between the damper and the second edge is larger than an elasticity of the damper and is larger than an elasticity of the second edge.

7. The loudspeaker according to claim 1, wherein the outer peripheral end of the damper is bent in a direction away from the diaphragm.

8. The loudspeaker according to claim 1, wherein an elasticity of the damper is larger than an elasticity of the diaphragm.

* * * * *